US005571378A

United States Patent [19]

Elofson et al.

[11] Patent Number: 5,571,378

[45] Date of Patent: Nov. 5, 1996

[54] PROCESS FOR HIGH-PH METAL ION CHELATION IN PULPS

[75] Inventors: Arne Elofson, Helsingborg; Arne Nordgren, Svalov, both of Sweden

[73] Assignee: Hampshire Chemical Ltd., London, United Kingdom

[21] Appl. No.: 327,919

[22] Filed: Oct. 27, 1994

Related U.S. Application Data

[63] Continuation-in-part of Ser. No. 156,572, Nov. 23, 1993, abandoned.

[51] Int. Cl.[6] ..... D21C 9/02; D21C 9/147; D21C 9/16

[52] U.S. Cl. ..... 162/65; 162/76; 162/78; 162/60

[58] Field of Search ..... 162/65, 76, 78, 162/60, 56

[56] References Cited

U.S. PATENT DOCUMENTS

| | | | |
|---|---|---|---|
| 3,764,464 | 10/1973 | Samuelson | 162/65 |
| 4,016,029 | 4/1977 | Samuelson | 162/65 |
| 4,087,318 | 5/1978 | Samuelson et al. | 162/65 |
| 5,211,811 | 5/1993 | Griggs et al. | 162/65 |
| 5,296,097 | 3/1994 | Friend | 162/65 |
| 5,360,514 | 11/1994 | Henricson et al. | 162/65 |

OTHER PUBLICATIONS

Appita 1991 6th International Symposium on Wood and Pulping Chemistry Proceedings vol. 1; "Controlling the Profile of Metals in the Pulp Before Hydrogen Peroxide Treatment"; J. Basta, et al.

Aticelca May 19–22, 1992, Bologna, Italy; "Developments of the Lignox Process"; Igerud, et al.

International Pulp Bleaching Contest, Jun. 11–14, 1991, Stockholm Sweden, "Reducing Levels of Aox—Part 3 Lowering of Kappa No. Prior to $ClO_2$ Bleaching", Basta, et al.

*Primary Examiner*—Steven Alvo

*Attorney, Agent, or Firm*—Nields & Lemack

[57] ABSTRACT

Process for high pH metal ion chelation in pulps. Extraction and removal of detrimental metal ions and organic solvent extractives prior to delignification and bleaching is carried out on pulp, preferably kraft pulp, at a pH over 5, more preferably a pH over 6, most preferably a pH of 7–9. Aqueous pulp is first brought to a pH of about 3–6 to cause chelation and desorption of metal ions from the fiber phase of the aqueous pulp, and at the same time implementing air entrainment and evaporation. The pH is then raised, and the extractable species are removed by dewatering and washing the pulp.

16 Claims, 1 Drawing Sheet

PROCESS FOR HIGH-PH METAL ION CHELATION IN PULPS

This application is a continuation-in-part of U.S. Ser. No. 08/156,572, filed Nov. 23, 1993, now abandoned.

BACKGROUND OF THE INVENTION

Concerns about effluents containing adsorbable organic halogens initiated a rapid development of non-chlorine containing alternatives for bleaching/delignification of chemical pulps. Such alternatives include oxygen ozone and hydrogen peroxide. By introduction of modified cooking processes and application of sequential bleachings using such oxygen compounds, it has been possible to achieve brightness levels of 85–87% ISO for soft wood kraft pulps.

A key factor in achieving feasible brightness levels and viscosities upon bleaching/delignification with peroxide, is pretreatment with a chelant ("Q-stage") prior to the peroxide bleaching ("P-stage"). This is a standard operation for removal of transition metal ions, in particular, manganese adsorbed to the fiber phase. Such extractions are typically carried out at a pH of 4.5 to 6. Manganese ions are not effectively chelated at pH's above 7, and therefore cannot be removed by dewatering and washing in a subsequent step. Alkaline extraction/washing is conventionally used in pulp making for achieving various characteristics of the pulp, but it has heretofore not been possible to combine it with an effective pretreatment of kraft pulps by chelants.

It is therefore an object of the present invention to provide a high-pH metal chelation process which for the pulp results in improved extraction of organic solvent extractives, improved washability of the pulp, and improved bleach response.

It is a further object of the present invention to provide a high-pH metal chelation process which for the pulp results in improved water absorption properties and improved taste and smell, particularly in the case of unbleached pulps.

It is a still further object of the present invention to provide a high-pH metal chelation process, which results in decreased formation of crusts in the production equipment.

SUMMARY OF THE INVENTION

The problems of the prior art have been overcome by the present invention, which provides a process for high pH-metal ion chelation in pulps. Extraction and removal of detrimental metal ions, preferentially manganese, prior to delignification and bleaching is carried out on pulp, preferably kraft pulp, at a pH above 5, more preferably above 6, most preferably at a pH of 7–9. In general terms, the pulp is in a first step brought to a pH within a range of 3–6, more preferably within a range of 4–5, to cause chelation and desorption of metal ions from the fiber phase of the aqueous pulp. Also, at that pH, evaporation and air entrainment is implemented to expel and oxidize anionic species, which in the second step would cause a redeposition of preferentially manganese. The pH is then in a second step raised to above 5, more preferably above 6, most preferably within a range from 7–9, and the extractable species (including chelated transition metals) are removed by dewatering and washing the pulp.

At the elevated pH in the second step, the process of the invention allows a higher level of fiber adsorbed calcium and magnesium, while maintaining a zero level of fiber adsorbed manganese due to the expelling and oxidation carried out in the first step. Magnesium is recognized as an effective peroxide stabilizer, retarding cellulose degradation as well, in elementally chlorine free (ECF) and totally chlorine free (TCF) bleaching. The instant process provides a convenient and efficient way to introduce additional magnesium to the system; instead of sodium hydroxide, magnesium hydroxide can be used to elevate the pH. At the elevated pH, much more magnesium is adsorbed to the fiber than in the case at the lower pH according to the conventional process. Additional magnesium also can be introduced to the pulp by addition to the bleach chemicals in the form of a chelate, so that any transition metal contaminants therein do not deleteriously effect the pulp.

DETAILED DESCRIPTION OF THE INVENTION

Figure 1:
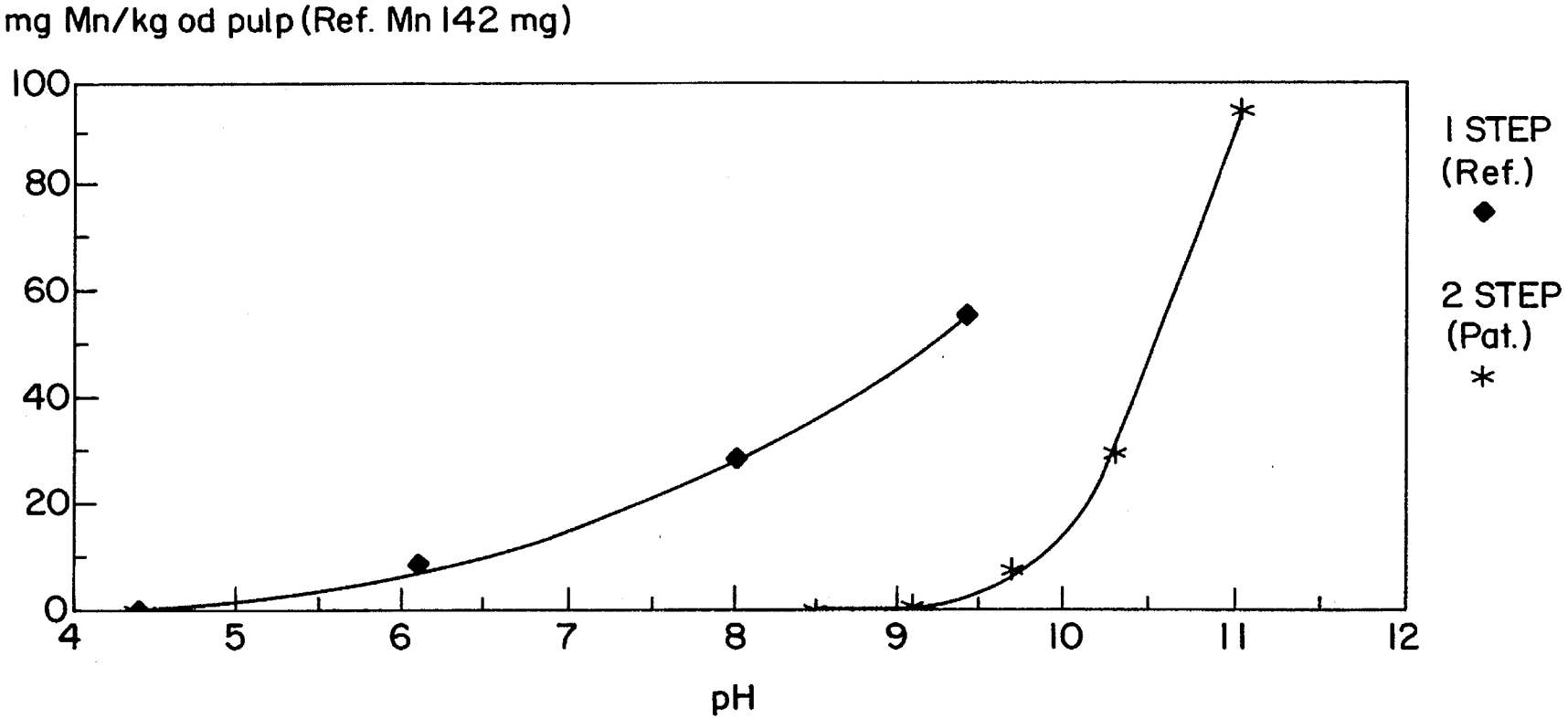
FIG. 1 is a graph illustrating metal ion adsorption versus pH in aqueous pulp slurry systems.

The present invention is directed towards a process for high-pH transition metal ion chelation for extraction and removal of detrimental metal ions prior to delignification/bleaching of cellulose pulps, particularly sulfate or so-called kraft pulps, employing preferentially hydrogen peroxide, but also other peroxides as well as oxygen and ozone, and to bleaching of mechanical pulps with hydrogen peroxide and dithionite or any other appropriate bleaching agent. Sulfate, or kraft pulp, is produced in a sodium-based alkaline delignification process in the presence of sulfidic and polysulfidic compounds. The present invention is not limited to said alkaline process, but rather includes all kinds of alkaline processes, with or without said sulfidic and polysulfidic compounds, or other additives, such as anthraquinone, which facilitates delignification. Furthermore, the invention includes other routes where delignification is achieved by chemicals such as sodium, magnesium and calcium sulphites, in so-called sulphite processes, or where delignification is achieved by organic liquids, such as methanol and ethanol, in a so-called organic solvent process, or where this process is combined with the sulfate or the sulfite process. Mechanical pulps include mechanical pulps in its original sense, such as ground wood, pressure ground wood, super pressure ground wood, refiner mechanical pulp, thermo mechanical pulp, etc., and mechanical pulps produced in a process where sulphite is used to provide improved defibration, such as chemi mechanical pulp, chemi thermo mechanical pulp, etc. Transition metal ions which can be chelated and desorbed in accordance with the present invention include metals such as manganese, iron, copper, nickel, cobalt, chromium, vanadium, molybdenum etc.

In the first step of the present process, carbon dioxide and sulfidic species such as hydrogen sulfide are expelled by evaporation and simultaneously, oxidation of the sulfidic species by air entrainment. This provides the complete chelation/desorbtion of metal ions, particularly manganese ions, which at an elevated pH are not redeposited onto the fiber phase. This first step is accomplished by mixing the pulp at a pH below 7, preferably at a pH of about 4–5 with a chelating agent, thereby at the same time protonizing fatty acid magnesium and calcium soaps into acid forms and releasing the magnesium and calcium ions into active peroxide stabilizers. Alternatively to or in addition to oxidation of sulfurous species by oxygen derived from the air, oxidation can be provided by any appropriate oxidizing agent added, such as elemental oxygen or peroxygen compounds. The evaporation and air entrainment implemented in the first step prevent the redeposition of manganese on the fiber at the elevated pH in the second step.

In a mill scale, air or oxygen entrainment for the oxidation may be provided by a medium consistency mixer (so-called "MC-mixer") by a well established technique for mixing gases or liquids in pulp.

The rate of the reaction depends upon, among other things, the oxygen concentration, i.e., the partial pressure of oxygen in the pulp mix. Accordingly, the pressure may be set at a level so as to give the appropriate reaction rate. Also, this technique allows a temperature above the boiling point of the pulp mix at normal pressure.

The evaporation may be achieved by running the process with the pressure relief valve on top of the autoclave slightly open, continuously or intermittently, allowing gas to escape and withdrawing carbon dioxide and hydrogen sulfide. Alternatively, the evaporation may be conducted as a pre-stage to the oxidation. To achieve the goal of removing detrimental species, a pressure spanning from superatmospheric pressure to a negative pressure (vacuum), may be employed.

On a lab scale, analogously the pressurized conditions have been achieved by conducting the process in an autoclave, with the air or the oxygen supplied by a gas cylinder via a pressure regulator. The regulator may be adjusted to give the appropriate pressure. Using oxygen at temperature between about 20° and 80° C. in the autoclave, a steady state consumption of oxygen gas proportional to the temperature, was recorded. This afforded an adequate annihilation of detrimental species within about 1 to 4 hours.

Experiments indicate that the oxidation is catalyzed by chelates formed with the transition metals and takes place at alkaline conditions in the second step of the process as well. Any conventional complexing agent or chelant, alone or in combination, can be used, such as aminocarboxylic acids such as ethylenediamine-tetraacetic acid (EDTA), 1,2-cyclohexylenediaminotetraacetic acid (CDTA), diethylenetriaminepentaacetic acid (DTPA), triethylenetetraaminehexaacetic acid (TTHA), nitrilotriacetic acid (NTA), hydroxy-ethylethylenediaminetriacetic acid (HEDTA), N,N-dihydroxyethyl-glycine (DHEG) , bis-(aminoethyl)-ether-N,N,N', N'- tetraacetic acid (AETA), 1,3-diamino-2-propanol-N,N,N', N'-tetraacetic acid (DPTA) , bit-(aminoethyl)-glycolether-N,N,N', N'-tetraacetic acid (EGTA), etc., aminophosphonic acids such as ethylenediaminetetramethylene-phosphonic acid (EDTMPA), diethylene-triaminepentamethylene-phosphonic acid (DTPMPA), phosphonic acids such as hydroxyethyldi-phosphonic acids (HEDP), etc., amino-carboxylic acids with phenyl substituents such as ethylenediamine-N,N'-di(o-hydroxyphenylacetic acid) (EDDHA), N,N'-di(o-hydroxybenzyl)-trimethylenediamine-N,N'-diacetic acid (TMHBED), etc., hydroxysulfobenzylaminocarboxylic acids such as N,N-bis(2-hydroxy-5-sulfobenzyl)glycine (available commercially as HAMPLEX DPS), etc., or mixtures of the foregoing. The preferred chelants are DTPA and TTHA in view of their extraordinary effective high-pH properties, especially at pH values over 7. Said chelants can be used alone or in combination with additives providing a deactivation of species detrimental for bleaching, such as transition metals. There are many theories about the mechanisms involved in the deactivation, such as free radical scavenging or masking of detrimental species by micelle or complex formation. The additives can be silicates or free radical scavengers of organic origin. Such additives are preferably added after the washing step. In order to decrease the pH of the aqueous pulp to the appropriate level in the first step, any suitable acid, organic or inorganic, such as formic acid, acetic acid, citric acid, tartaric acid, sulfuric acid, hydrochloric acid, etc., can be used. The second step in the process is the alkaline hydrolysis of oxidized organic species while maintaining the chelation of metal ions, particularly manganese ions, and turning the fatty acids into preferentially sodium soaps. The result is improved extractability of organic solvent extractives, fatty acids, rosin acids, resin acids, etc.

The pulp from the first step containing the chelating agent is then brought to a pH above 5, more preferably a pH above 6, most preferably a pH in the range of about 7–9 with a suitable base, such as sodium, calcium or magnesium hydroxide or oxide. The magnesium and/or calcium bases are preferred, in view of their ability to stabilize bleaches. Magnesium and calcium also can be separately added in the form of chelates, preferably after the final step. TTHA is particularly appropriate as a chelant because of its good chelating capacity for earth alkali metals observed in alkaline solutions.

The second step may be omitted, thereby still taking advantage of the benefits gained by the process conducted in the first step. Alternatively, the first step or the first and second steps may be repeated or combined with the conventional pretreatment route in a sequence, without departing from the spirit and scope of the present invention.

Formation of crust in equipment is an increasing problem in modern low effluent ("closed") mills with elementally chlorine free or totally chlorine free bleaching. Except for the expensive maintenance with frequent "descaling", causing disturbances in the production, corrosion and erosion increases, which decreases the life of the equipment. Where crust formation is a problem, the high pH in the second step of the process provides appropriate chelation and solubility conditions to prevent formation of crusts consisting of barium sulfate, calcium carbonate oxalate, etc., in digesters, reactors, vessels, pumps and tubing. Via the filtrate, the dissolved crust forming compounds can be separated from the cycle and treated separately.

The alkaline pretreatment with chelants also permits a simultaneous treatment with enzymes acting in alkaline biobleachings. Alkaline hemicellulases of xylanase type are claimed to have good bleach boosting effects at about pH 8–9 at residence times of 2–4 hours. Enzymes working at acid pH (4–5) seem to require long treatment times (12–24 hours), according to Pedersen et al., "Bleach Boosting of Kraft Pulp Using Alkaline Hemicellulases", SPCI-International Pulp Bleaching Conference, Proceedings 2, p. 107 (1991). By using the process of the present invention, optimal conditions can be achieved, and species "poisonous" to the enzyme may be converted to harmless species.

The final step of the present process is the dewatering and washing of the pulp to remove the extractable species generated in the previous steps. An additional dewatering and washing step can be employed subsequent to the first step of mixing the pulp with a chelant at a pH below 7, where extra loss of free magnesium and calcium ions is not a concern. The additional dewatering and washing step may be desirable where crust formation in equipment is a problem.

Temperatures are not critical, but for the sake of convenience should generally be kept within a range of about 40°–80° C., which is the temperature range normally occurring in pulping. The reaction time is inversely dependent on the temperature, and is therefore correlated to the temperature. Pulp consistencies are not critical, as long as the pulp is not too viscous that mixing becomes problematic, or not so diluted that volume and energy constraints become problematic. The invention can be carried out at any suitable pressure according to the desired benefits in pulp production such as where oxygen or ozone is used or where the temperature would be over the boiling point at normal pressure.

The present invention is applicable to chemical pulps, mechanical pulps and to recycled pulps, as well as to nonbleaching routes in which all of the aforementioned benefits are realized except for those specific to bleaching. The high-pH transition metal ion chelation of particularly manganese ions, preferably within a pH of 7–9, for extraction and removal of detrimental metal ions prior to bleaching of mechanical pulps, and to delignification/bleaching of cellulose pulps, particularly kraft pulps, but also sulphite pulps and semi chemical pulps, employing preferentially hydrogen peroxide, but also oxygen and ozone, allows for improved extraction, washability and bleach response.

FIG. 1 demonstrates the improved extraction performance obtained in accordance with the present invention. At pH regions from about 4 to about 9, the amount of manganese adsorbed onto the pulp fibers in the aqueous pulp slurry system is almost zero when the process of the present invention is carried out, compared to from zero to about 45–50 mg Mn/kg o.d. pulp when using conventional processes such as Basta et al., "Controlling The Profile of Metals in the Pulp Before Hydrogen Peroxide Treatment", 6th International Symposium on Wood and Pulping Chemistry, Proceedings 1, p. 237, FIG. 2, page 239. By operating according to the route of the present invention, with an initial step involving evaporation and air entrainment at low pH step affording nullification of detrimental species, followed by a subsequent high pH step (involving formation of sodium soaps, etc.), a complete chelation of Mn ions is achieved in the subsequent high pH step. Additional benefits, such as improved extraction, improved pulp washability, improved bleach response, and improved handling characteristics in paper machines, are also realized. In the subsequent dewatering and washing step, the manganese ions and detrimental reaction products are removed from the pulp. In contrast, the prior art does not disclose an evaporation and oxidation, and therefore does not achieve a zero level of fiber adsorbed manganese at an elevated pH.

The present invention will be better understood by referring to the following specific but non-limiting examples. It should be understood that said invention is not limited by these examples which are offered merely as illustrations; it should be also understood that modifications can be made without departing from the spirit and scope of the invention.

EXAMPLE 1

The pulp used was a hard wood (birch) kraft pulp, which after cooking had been oxygen delignified and finally washed with fresh water on a drumfilter, in a so-called open wash. The pulp had a kappa number of 6, a pH of 10.1 and a manganese content of 97 ppm manganese on oven dry pulp. 47.3 g of the aqueous hard wood kraft pulp corresponding to 10 g of oven dried (o.d.) pulp was diluted to 3.3% with deionized water containing 3.2 g of 0.01 Molal TTHA sodium salt. The pH was adjusted to about 4 with 0.2 Molal sulfuric acid. Over a period of one hour, the pulp slurry was agitated at 75° C. under air entrainment and evaporation in a vented roundbottomed glass flask (Duran). Afterwards, the pH was checked and found to be 4.3.

The pH was then adjusted with 0.2 Molal sodium hydroxide to about 9, and again the pulp slurry was stirred at 75° C. for one hour. The pH was then checked and found to be 8.5.

The pulp slurry was filtered on a nylon filter to give about 34 g of s pulp with 29–30% consistency. Assay of the filtrate and filter cake gave a zero level of fiber adsorbed manganese. Assay of untreated pulp gave 97 ppm manganese.

REFERENCE EXAMPLE 1

In a reference experiment run directly in a single high-pH-stage, the same amount of pulp at 3.3% consistency as used in Example 1 was agitated with 3.2 g of 0.01 Molal EDTA sodium salt at 75° C. over a period of one hour, giving a final pH of 8.0. Assay of filtrate and filter cake gave in this case 29 ppm fiber adsorbed manganese, indicating that in the absence of the low-pH first stage of the process according to the present invention, the manganese cannot be effectively chelated/desorbed.

EXAMPLE 2

Example 1 was repeated, except that the pulp used had a kappa number of 11 and a pH of 8.7, and sufficient 0.2 Molal sodium hydroxide was added to obtain a final pH of 9.2. The assay gave <1 ppm of fiber adsorbed manganese. For comparison, the assay of untreated pulp was 142 ppm of fiber adsorbed manganese.

REFERENCE EXAMPLE 2

Reference Example 1 was repeated, except that the pulp of Example 2 was used. The final pH was 9.4, and the assay was 56 ppm of fiber adsorbed manganese, showing that in the absence of the low-pH first stage of the process according to the present invention, the manganese cannot be effectively chelated/desorbed.

EXAMPLE 3

The pulp used was a soft wood kraft pulp, which after cooking had been oxygen delignified and counter current washed on two wash presses in series. The pulp had the following physical data: Consistency 34.5%; pH 10.4; Kappa number 8.4; Intrinsic viscosity (SCAN-CM 15:88) 844 $dm^3/kg$; Brightness 40.9% ISO; Manganese 67 ppm; Magnesium 540 ppm; Calcium 1550 ppm.

In a first step, 57.9 g of the above pulp, corresponding to 20 g of o.d. pulp, was diluted to 3.3% consistency with deionized water containing 11.0 g of 0.01 Molal DTPA sodium salt. The pH was then adjusted to about 4 with 11.0 g of 0.2 Molal sulfuric acid, making a total batch of 600 g. The pulp slurry was heated at 75° C. in a 1 liter wide necked polypropene bottle over a period of two hours, which was interrupted by eight, evenly-distributed, two minute shaking-agitation periods, giving a final steady state pH of 4.6. The bottle was open, except during the shaking-agitation periods, permitting about 3% of its contents to evaporate.

In a second step, the pH was adjusted with 4.0 g of 0.2 Molal sodium hydroxide to about 8, and the slurry was heated at 75° C. with agitation as in the first step. The final steady state pH was 7.5.

The pulp slurry was filtered on a nylon filter and the pulp obtained was washed on the filter with 9×50 ml of deionized water; each washing combined with kneading. This gave 62.4 g of pulp at a consistency of about 32%. Assay of the pulp gave the magnesium and calcium levels shown in Table 1. These are higher than those related to the reference extraction obtained in REFERENCE EXAMPLE 3 below. High levels are beneficial for the bleach response and the viscosity of the pulp.

Half the pulp from the extraction (31.2 g) containing 10 g of o.d. pulp was submitted to a pressurized bleaching at 10% consistency, using an electrically heated 1 liter stainless steel autoclave (Parr Instrument Company), serving merely as a pressure water bath. The autoclave was equipped with a pressure gauge, thermostat and thermometer.

Based on o.d. pulp, 4.25 g (1.7%) of 1.0 Molal NaOH and 5.79 g (3.7%) of a 6.4% $H_2O_2$ solution dissolved in 58.8 g of deionized water, was kneaded into the pulp giving an initial pH of 11.3. The pulp was transferred to a 125 ml wide necked TEFLON bottle, which together with a reference (REFERENCE EXAMPLE 3), was immersed in water filled to a certain level in the bottom of the autoclave.

The pulps were reacted at 125° C. (2.3 bar) for 2 hours. The pulp according to the invention obtained a final pH of 9.2. It was mixed with 50 ml of 0.04 Molal sulfuric acid, and the mixture was filtered on a nylon filter, giving 27.3 g of pulp and 121.2 g of filtrate. The filtrate was titrated for residual peroxide and ISO-brightness was measured on hand sheets made from the pulp. The results obtained are shown in Table 2. Comparison with the reference reveals that about 3 ISO units higher brightness was achieved when using the instant process, which is a significant difference at the actual high brightness levels.

REFERENCE EXAMPLE 3

The same pulp was used as in EXAMPLE 3.

The conventional method differs from that of the present invention in that the extraction is carried out in one or more low-pH steps (each step with subsequent washing), in closed vessels or in vessels without evaporation/aeration and normally, but not necessarily, at a somewhat higher pH, other conditions being essentially the same.

Thus, in a first step, 57.3 g of the pulp, corresponding to 20 g of o.d. pulp, was diluted to 3.3% consistency with deionized water containing 11.0 g of 0.01 Molal DTPA sodium salt. The pH was adjusted to about 4 with 11.0 g of 0.2 Molal sulfuric acid, making a total batch of 600 g. The pulp slurry was heated at 75° C. in a 1 liter wide necked polypropene bottle over a period of two hours, interrupted by eight, evenly distributed, two minute shaking-agitation periods, giving a final steady state pH of 4.8. This operation was carried out with reflux condensation of vapors.

The pulp slurry was filtered on a nylon filter and the pulp obtained was washed on the filter with 9×50 ml of deionized water; each washing combined with kneading. This gave 64.9 g of pulp at a consistency of about 31%. Assay of the pulp gave the magnesium and calcium levels shown in Table 1. As can be seen from Table 1, these levels are lower than those obtained for the pulp extracted according to the present invention.

Half the pulp from the extraction (32.5 g) containing 10 g of o.d. pulp was submitted to a pressurized bleaching at 10% consistency together with and as a reference to, the pulp extracted according to the invention as described in EXAMPLE 3 above.

Thus, based on o.d. pulp, 4.25 g (1.7%) of 1.0 Molal NaOH and 5.79 g (3.7%) of a 6.4% $H_2O_2$ solution dissolved in 58.8 g of deionized water, was kneaded into the pulp giving an initial pH of 11.2. The pulp was transferred to a 125 ml wide necked TEFLON bottle, which together with the pulp of EXAMPLE 3, was immersed in water in the stainless steel autoclave described in EXAMPLE 3.

The pulps were reacted at 125° C. (2.3 bar) for 2 hours. The reference pulp obtained a final pH of 9.6. It was mixed with 50 ml of 0.04 Molal sulfuric acid, and the mixture was filtered on a nylon filter, giving 28.2 g of pulp and 120.5 g of filtrate. The filtrate was titrated for residual peroxide and ISO-brightness was measured on hand sheets made from the pulp. The results obtained are shown in Table 2.

EXAMPLE 4

The same pulp was used as in EXAMPLE 3.

In a first step, 57.9 g of the above pulp, corresponding to 20 g of o.d. pulp, was diluted to 3.3% consistency with deionized water containing 11.0 g of 0.01 Molal DTPA sodium salt. The pH was then adjusted to about 4 with 11.0 g of 0.2 Molal sulfuric acid, making a total batch of 600 g. The pulp slurry was heated at 75° C. in a 1 liter wide necked polypropene bottle over a period of two hours, which was interrupted by eight, evenly-distributed, two minute shaking-agitation periods, giving a final steady state pH of 4.6. The bottle was open, except during the shaking-agitation periods, permitting about 3% of its contents to evaporate.

In a second step, the pH was adjusted with 4.0 g of 0.2 Molal sodium hydroxide to about 8, and the slurry was heated at 75° C. with agitation as in the first step. The final steady state pH was 7.8.

The pulp slurry was filtered on a nylon filter and the pulp obtained was washed on the filter with 9×50 ml of deionized water; each washing combined with kneading. This gave 63.1 g of pulp at a consistency of about 32%. Assay of the pulp gave the magnesium and calcium levels shown in Table 1. These levels are higher than those related to the reference extraction obtained in REFERENCE EXAMPLE 4 below. High levels are beneficial for the bleach response and the viscosity of the pulp.

Half the pulp from the extraction (31.6 g) containing 10 g of o.d. pulp was submitted to a pressurized bleaching at 10% consistency, using the autoclave described in EXAMPLE 3.

Based on o.d. pulp, 4.25 g (1.7%) of 1.0 Molal NaOH and 5.79 g (3.7%) of a 6.4% $H_2O_2$ solution dissolved in 57.9 g of deionized water, was kneaded into the pulp giving an initial pH of 11.3. The pulp was transferred to a 125 ml wide necked TEFLON bottle, which together with a reference (REFERENCE EXAMPLE 4), was immersed in water filled to a certain level in the bottom of the autoclave.

The pulps were reacted at 125° C. (2.3 bar) for 2 hours. The pulp according to the invention obtained a final pH of 7.9. It was mixed with 50 ml of 0.04 Molal sulfuric acid, and the mixture was filtered on a nylon filter, giving 27.9 g of pulp and 119.0 g of filtrate. The filtrate was titrated for residual peroxide and ISO-brightness was measured on hand sheets made from the pulp. The results obtained are shown in Table 2. Comparison with the reference reveals that about 3 ISO units higher brightness was achieved when using the instant process, which is a significant difference at the actual high brightness levels.

REFERENCE EXAMPLE 4

The same pulp was used as in EXAMPLE 4.

The conventional method differs from that of the present invention in that the extraction is carried out in one or more low-pH steps (each step with subsequent washing), in closed vessels or in vessels without evaporation/aeration and normally, but not necessarily, at a somewhat higher pH, other conditions being essentially the same.

Thus, in a first step, 57.3 g of the pulp, corresponding to 20 g of o.d. pulp, was diluted to 3.3% consistency with deionized water containing 11.0 g of 0.01 Molal DTPA sodium salt. The pH was adjusted to about 4.5 with 9.9 g of 0.2 Molal sulfuric acid, making a total batch of 600 g. The pulp slurry was heated at 75° C. in a 1 liter wide necked polypropene bottle over a period of two hours, interrupted by eight, evenly distributed, two minute shaking-agitation periods, giving a final steady state pH of 5.6. This operation was carried out in a closed bottle.

The pulp slurry was filtered on a nylon filter and the pulp obtained was washed on the filter with 9×50 ml of deionized water; each washing combined with kneading. This gave 63.1 g of pulp at a consistency of about 32%. Assay of the pulp gave the magnesium and calcium levels shown in Table 1. As can be seen from Table 1, these levels are lower than those obtained for the pulp extracted according to the present invention.

Half the pulp from the extraction (31.5 g) containing 10 g of o.d. pulp was submitted to a pressurized bleaching at 10% consistency together with and as a reference to, the pulp extracted according to the invention as described in EXAMPLE 4 above.

Thus, based on o.d. pulp, 4.50 g (1.7%) of 1.0 Molal NaOH and 5.79 g (3.7%) of a 6.4% $H_2O_2$ solution dissolved in 58.3 g of deionized water, was kneaded into the pulp giving an initial pH of 11.2. The pulp was transferred to a 125 ml wide necked TEFLON bottle, which together with the pulp of EXAMPLE 4, was immersed in water in the stainless steel autoclave described in EXAMPLE 3.

The pulps were reacted at 125° C. (2.3 bar) for 2 hours. The reference pulp obtained a final pH of 7.8. It was mixed with 50 ml of 0.04 Molal sulfuric acid, and the mixture was filtered on a nylon filter, giving 29.9 g of pulp and 118.0 g of filtrate. The filtrate was titrated for residual peroxide and ISO-brightness was measured on hand sheets made from the pulp. The results obtained are shown in Table 2.

TABLE 1

| | Chelants metal ion extractions (Q-stage): | | | | |
|---|---|---|---|---|---|
| | pH | | Fiber adsorbed met.ions (ppm) before washing | | |
| | 1 | 2 | Mg | Ca | Remarks |
| Ex. 3 | 4.6 | 7.5 | 157 | 519 | According to the invention |
| Ref. ex. 3 | 4.8 | | 69 | 256 | Reference: Conv. extraction at open reflux condensation |
| Ex. 4 | 4.6 | 7.8 | 157 | 519 | According to the invention |
| Ref. ex. 4 | 5.6 | | 128 | 402 | Reference: Conventional metal ion extraction in a closed vessel |

TABLE 2

| | Pressurized peroxide bleachings (P-stage): | | | |
|---|---|---|---|---|
| | Bleach time h | Residual peroxid % | Bright-ness % ISO | Remarks |
| Ex. 3 | 2 | 13.4 | 85.6 | Related to Q-stage according to the invention at pH 4.6 |
| Ref. ex. 3 | 2 | 11.3 | 82.2 | Reference: Related to Conv. Q-stage at pH 4.8; Reflux cond. |
| Ex. 4 | 4 | 0.1 | 83.1 | Related to Q-stage according to the invention at pH 4.6 |
| Ref. ex. 4 | 4 | 0 | 80.2 | Reference: Related to Conv. Q-stage at pH 5.6; Closed vessel |

EXAMPLE 5

The pulp used was a soft wood kraft pulp, which after cooking had been oxygen delignified and counter-current washed on two wash presses in series. The pulp had the following physical data: Consistency 33.9%; pH 10.4; Kappa number 8.4; Intrinsic viscosity (SCAN-CM 15:88) 844 $dm^3/kg$; Brightness 40.9%ISO; Manganese 67 ppm; Magnesium 540 ppm; Calcium 1550 ppm.

The pulp (29.5 g) containing 10 g of o.d. pulp, was submitted to a chelants extraction 12.5% consistency, using an electrically heated 1 liter stainless steel autoclave (PARR INSTRUMENT COMPANY), serving also as a pressure water bath. The autoclave was equipped with oxygen supply, pressure gauge, thermostat and thermometer.

In a first step, 29.5 g of the above pulp, corresponding to 10 g of o.d. pulp, was in a 125 ml wide necked polypropylene bottle mixed with deionized water containing 5.5 g of 0.01 Molal DTPA sodium salt and 5.5 g of 0.2 Molal sulfuric acid, making a total batch of 80 g at a consistency of 12.5% and a pH of 4.4. The open bottle was placed in a water bath at 75° C. and evaporation was conducted for about one hour. Then the bottle with an open screw cap was placed in the autoclave with water up to a certain level of the bottle and the autoclave was heated at 40° C. and 5 bar oxygen pressure. The oxygen was supplied by a gas cylinder via a pressure regulator. A final steady state pH of 4.7 was obtained.

In a second step, the pH was adjusted with 2.0 g of 0.2 Molal sodium hydroxide to about 8 and the same procedure was repeated. The final steady state pH was 7.5.

The pulp slurry was filtered on a nylon filter and the pulp obtained was washed on the filter with 9×50 ml of deionized water; each washing combined with kneading. This gave 31.2 g of pulp at a consistency of about 32%.

The ISO-brightness was measured on hand sheets made from the pulp. It gave a brightness of 46.5% ISO. This is about 4 ISO units higher than the reference metal ion extraction in Example 4, which gave a brightness of 42.4% ISO.

What is claimed is:

1. A process for metal ion chelation in pulps, comprising:

(a) mixing aqueous pulp containing transition metals with a chelating agent at a pH of 1–6, to form an aqueous pulp mix including chelated transition metals;

(b) subsequently oxidizing sulfurous species and expelling carbon dioxide and sulfurous species from said aqueous pulp mix so as to inhibit redeposition of said chelated transition metals upon pH adjustment in step (c);

(c) subsequently adjusting the pH of said aqueous mix to a pH above 6;

(d) dewatering and washing said mix to remove said chelated transition metals from said mix after adjusting the pH of said mix in step (c); and (e) subsequently subjecting said dewatered and washed mix to a delignification bleaching.

2. The process of claim 1, wherein the pH in step (a) is 3–6.

3. The process of claim 1, wherein the pH in step (c) is 7–9 .

4. The process of claim 1, wherein said chelating agent is selected from the group consisting of aminocarboxylic acid, aminophosphonic acid, phosphonic acid and hydroxysulfobenzylaminocarboxylic acid chelating agents.

5. The process of claim 1, wherein said chelating agent is triethylenetetraaminehexaacetic acid.

6. The process of claim 1, wherein said chelating agent is diethylenetriaminepentaacetic acid.

7. The process of claim 1, wherein said chelating agent is an aminocarboxylic acid.

8. The process of claim 1, wherein said chelating agent is an aminophosphonic acid.

9. The process of claim 1, wherein said chelating agent is a hydroxysulfobenzylaminocarboxylic acid.

10. The process of claim 1, wherein a zero level of fiber adsorbed manganese is achieved.

11. A process for metal ion chelation in pulps, comprising:

(a) mixing aqueous pulp containing transition metals with a chelating agent at a pH of 1–5, to form an aqueous pulp mix including chelated transition metals;

(b) subsequently oxidizing sulfurous species and expelling carbon dioxide and sulfurous species from said aqueous pulp mix so as to inhibit redeposition of said chelated transition metals upon pH elevation in step (c) ;

(c) subsequently adjusting the pH of said aqueous mix to a pH above 5;

(d) dewatering and washing said mix to remove said chelated transition metals after adjusting the pH of said mix in step (c); and (e) subsequently subjecting said dewatered and washed mix to a delignification bleaching step.

12. The process of claim 11, wherein the pH in step (a) is 4–5.

13. The process of claim 11, wherein the pH in step (c) is 6–12.

14. The process of claim 11, wherein said chelating agent is selected from the group consisting of aminocarboxylic acid, aminophosphonic acid, phosphonic acid and hydroxysulfobenzylaminocarboxylic acid chelating agents.

15. The process of claim 11, wherein said chelating agent is selected from the group consisting of triethylenetetraaminehexaacetic acid, diethylenetriaminepentaacetic acid and hydroxysulfobenzylaminocarboxylic acid.

16. The process of claim 11, wherein a zero level of fiber adsorbed manganese is achieved.

* * * * *